US007811136B1

(12) United States Patent
Hsieh et al.

(10) Patent No.: US 7,811,136 B1
(45) Date of Patent: Oct. 12, 2010

(54) PIVOT PLUG CONNECTOR

(75) Inventors: Juchu Hsieh, Hsin-Tien (TW); Nakahara Tomomi, Hsin-Tien (TW)

(73) Assignees: Advanced Connectek Inc., Hsin-Tien, Taipei-Hsien (TW); Advanced Connectek (Japan) Ltd., Yokohama, Kanagawa-ken (JP)

( * ) Notice: Subject to any disclaimer, the term of this patent is extended or adjusted under 35 U.S.C. 154(b) by 0 days.

(21) Appl. No.: 12/559,514

(22) Filed: Sep. 15, 2009

(30) Foreign Application Priority Data

Aug. 12, 2009 (TW) ..... 98214827 U

(51) Int. Cl.
*H01R 39/00* (2006.01)

(52) U.S. Cl. ..... 439/640; 439/31; 439/165; 439/11

(58) Field of Classification Search ..... 439/31, 439/165, 467
See application file for complete search history.

(56) References Cited

U.S. PATENT DOCUMENTS 5,658,152 A * 8/1997 Selker ..... 439/31
5,860,824 A * 1/1999 Fan ..... 439/265
6,213,782 B1 * 4/2001 Derstine ..... 439/31
6,338,645 B1 * 1/2002 Tan et al. ..... 439/446
6,475,021 B1 * 11/2002 Tan et al. ..... 439/446
6,786,734 B2 * 9/2004 Yu ..... 439/11
6,991,467 B1 * 1/2006 Cheng et al. ..... 439/10
7,121,852 B2 * 10/2006 Ng et al. ..... 439/131
7,128,615 B1 * 10/2006 Liao ..... 439/640
7,172,428 B2 * 2/2007 Huang ..... 439/31
7,614,903 B1 * 11/2009 Huang ..... 439/446
7,670,190 B2 * 3/2010 Shi et al. ..... 439/640
2008/0227338 A1 * 9/2008 Lin et al. ..... 439/640

* cited by examiner

*Primary Examiner*—Briggitte R Hammond
(74) *Attorney, Agent, or Firm*—Pearne & Gordon LLP

(57) ABSTRACT

A pivot plug connector has a cable mount, a pivoting member, a rotating member and a plug head. The cable mount is mounted on a cable. The pivoting member is connected pivotally to the cable mount. The rotating member is connected rotatably to the pivoting member. The plug head is mounted on the rotating member. When plugged into a socket connector, the pivot plug connector pivots and rotates to change its configuration and prevent interfering with nearby plug connectors.

10 Claims, 11 Drawing Sheets

PIVOT PLUG CONNECTOR

BACKGROUND OF THE INVENTION

1. Field of the Invention

The present invention relates to a connector, and more particularly to a pivot plug connector that has a cable mount and a plug head mounted pivotally and rotatably on the cable mount. When plugged into in a socket connector the plug connector can be adjusted to avoid other plug connector and wires.

2. Description of Related Art

Connectors are used to allow data transmission between electronic devices through cables.

Conventional connectors include socket connectors mounted on the electronic devices and plug connectors mounted on cables. A cable having two plug connectors on opposite ends is plugged into two socket connectors of two electronic devices to effect data transmission therebetween.

However, electronic devices such as computers and monitors have a back panel with various socket connectors. When multiple plug connectors are connected to the socket connectors, plugs and cables may block each other so prevent full utilization of the socket connectors.

To overcome the shortcomings, the present invention provides a pivot plug connector to mitigate or obviate the aforementioned problems.

SUMMARY OF THE INVENTION

The main objective of the invention is to provide a pivot plug connector that has a cable mount and a plug head mounted pivotally and rotatably on the cable mount. The pivot plug connector is plugged into a socket connector and adjusted to prevent interference with nearby plug connectors and wires.

A pivot plug connector in accordance with present invention has a cable mount, a pivoting member, a rotating member and a plug head. The cable mount is mounted on a cable. The pivoting member is connected pivotally to the cable mount. The rotating member is connected rotatably to the pivoting member. The plug head is mounted on the rotating member. When plugged into a socket connector, the pivot plug connector pivots and rotates to adjust position and prevent interfering with nearby plug connectors and wires.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
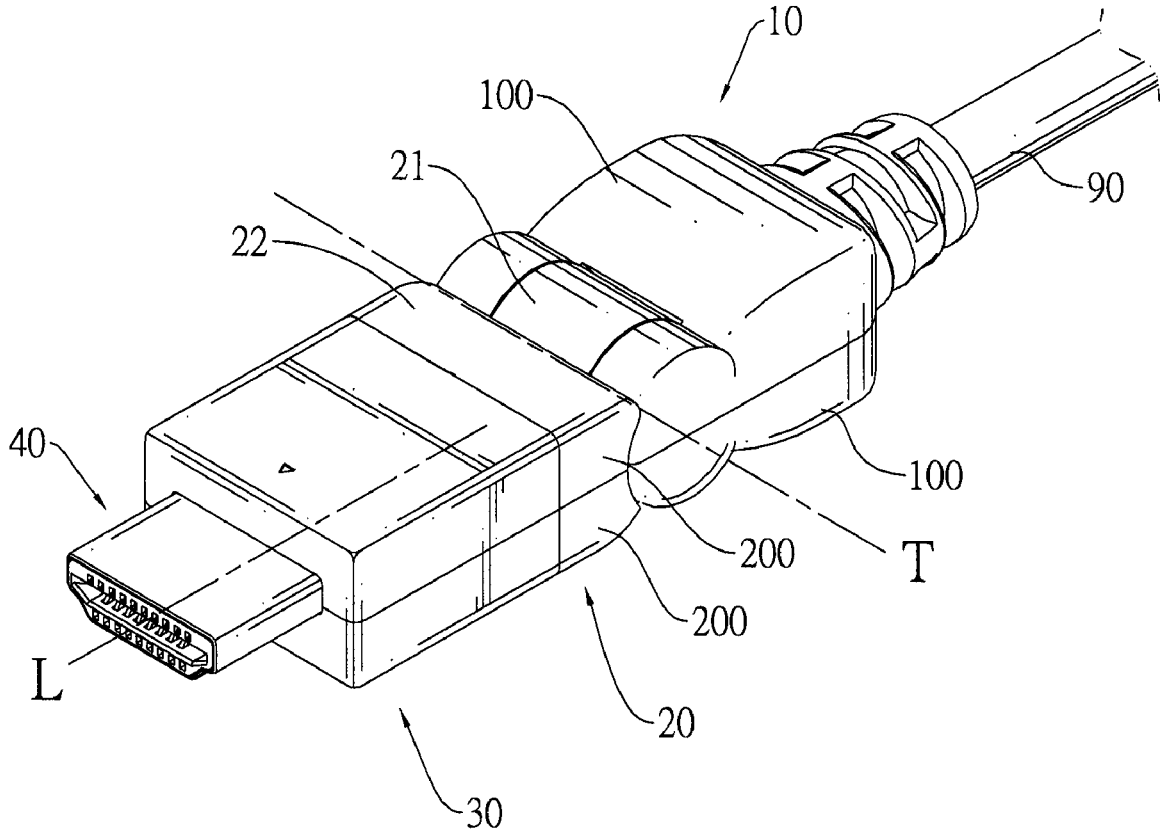
FIG. 1 is a perspective view of a pivot plug connector in accordance with the present invention.
Figure 2:
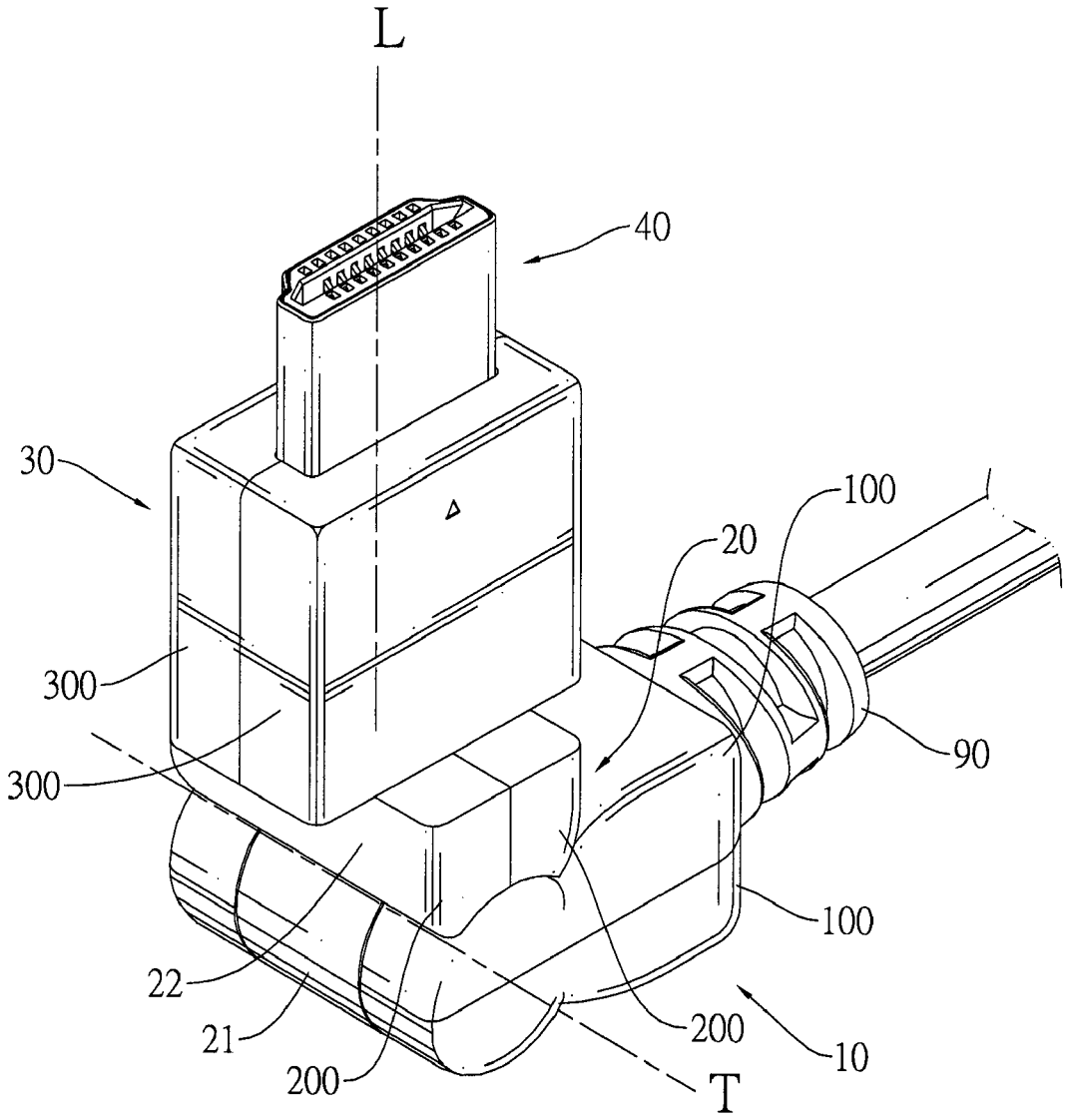
FIG. 2 is an operational perspective view of the plug head pivoting and rotating relative to the cable mount of the pivot plug connector in FIG. 1.
Figure 3:
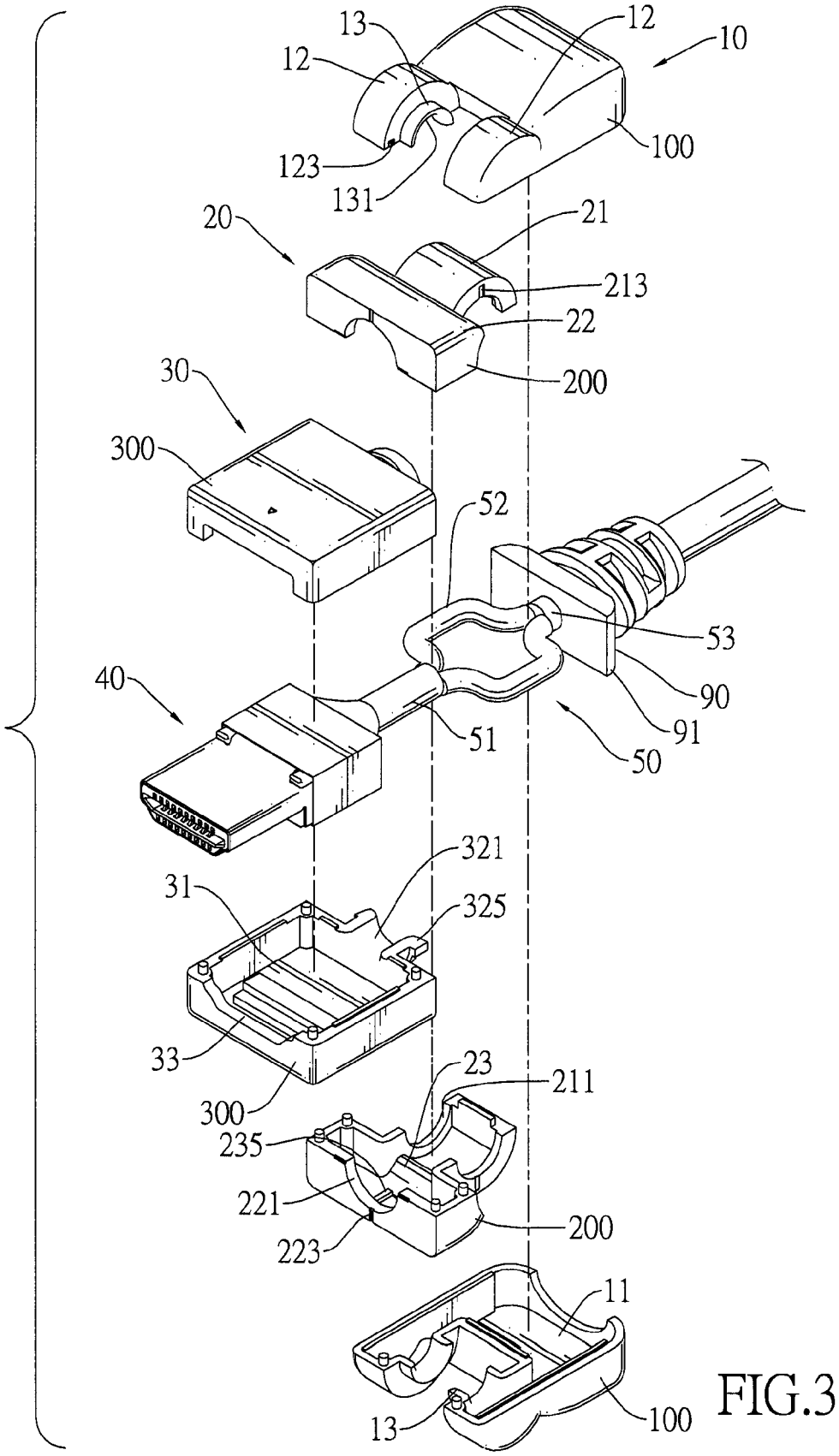
FIG. 3 is an exploded front perspective view of the pivot plug connector in FIG. 1.
Figure 4:
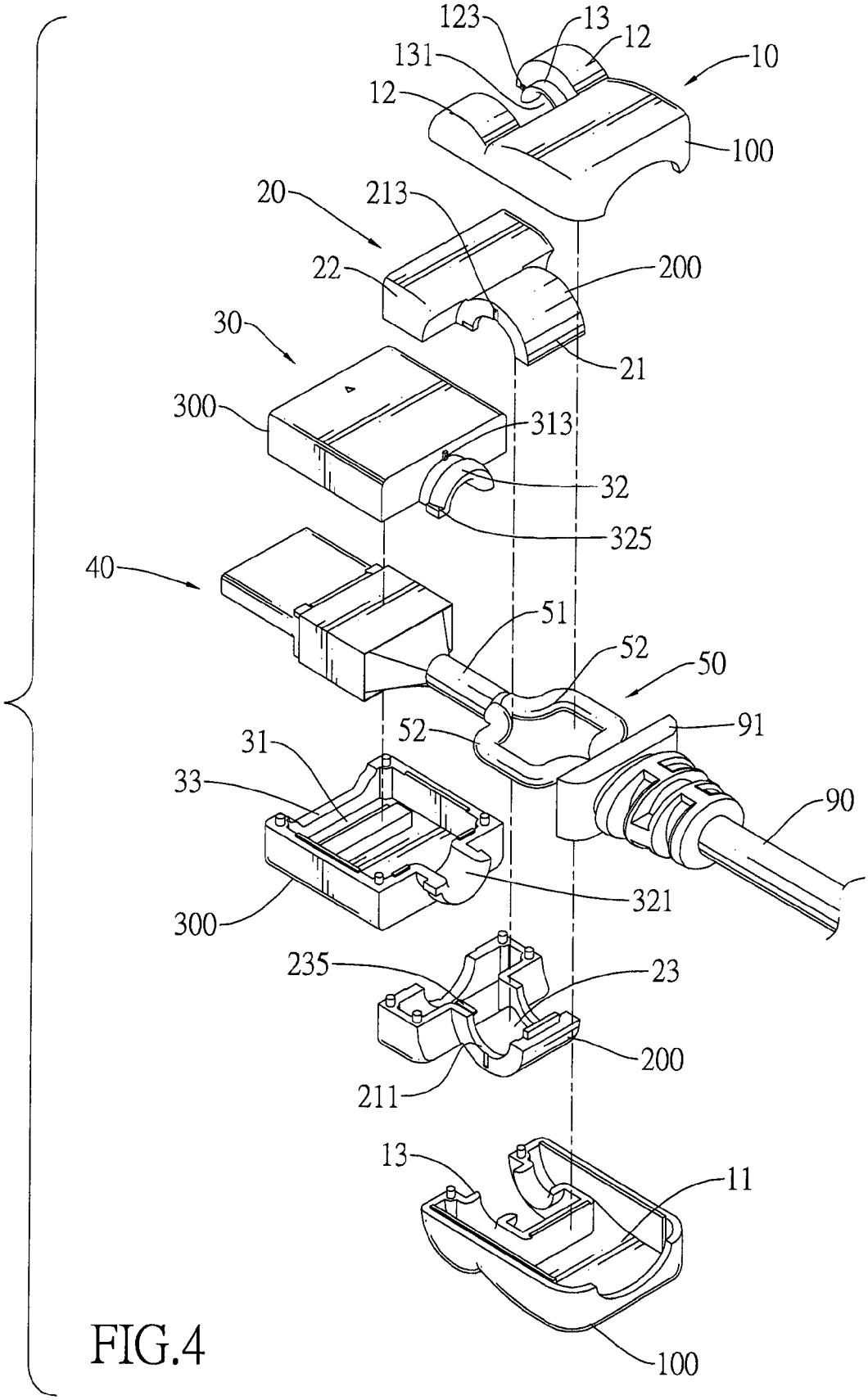
FIG. 4 is an exploded rear perspective view of the pivot plug connector in FIG. 1.

With reference to FIGS. 1 to 4, a pivot plug connector in accordance with the present invention may comply with the high-definition multimedia interface (HDMI) standard and may be connected to a cable (90) that has two ends and a mounting block (91) on one end.

The pivot plug connector comprises a cable mount (10), a pivoting member (20), a rotating member (30), a plug head (40) and an internal cable (50).

The cable mount (10) may consist of two substantially symmetrical casing halves (100) and has a front end, a rear end, a transverse axis (T) and a cavity (11) and may further have two pivot brackets (12), an interval, and two pivot pins (13).

The cavity (11) is defined in the cable mount (10) and holds the mounting block (91) of the cable (90).

Figure 9:
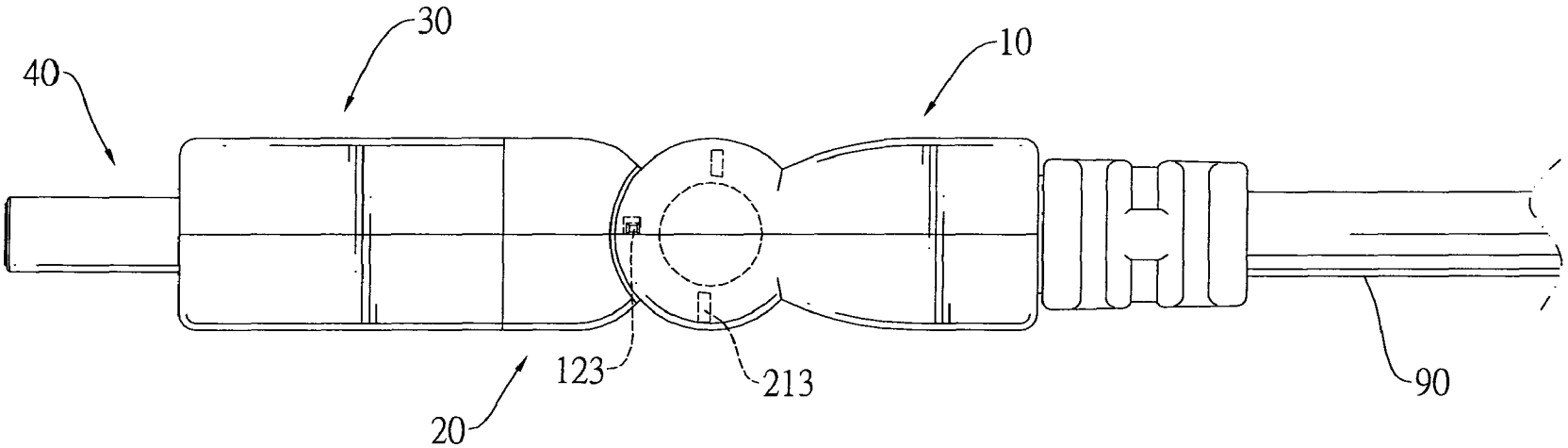
FIG. 9 is a side view of the pivot plug connector in FIG. 1.
Figure 10:
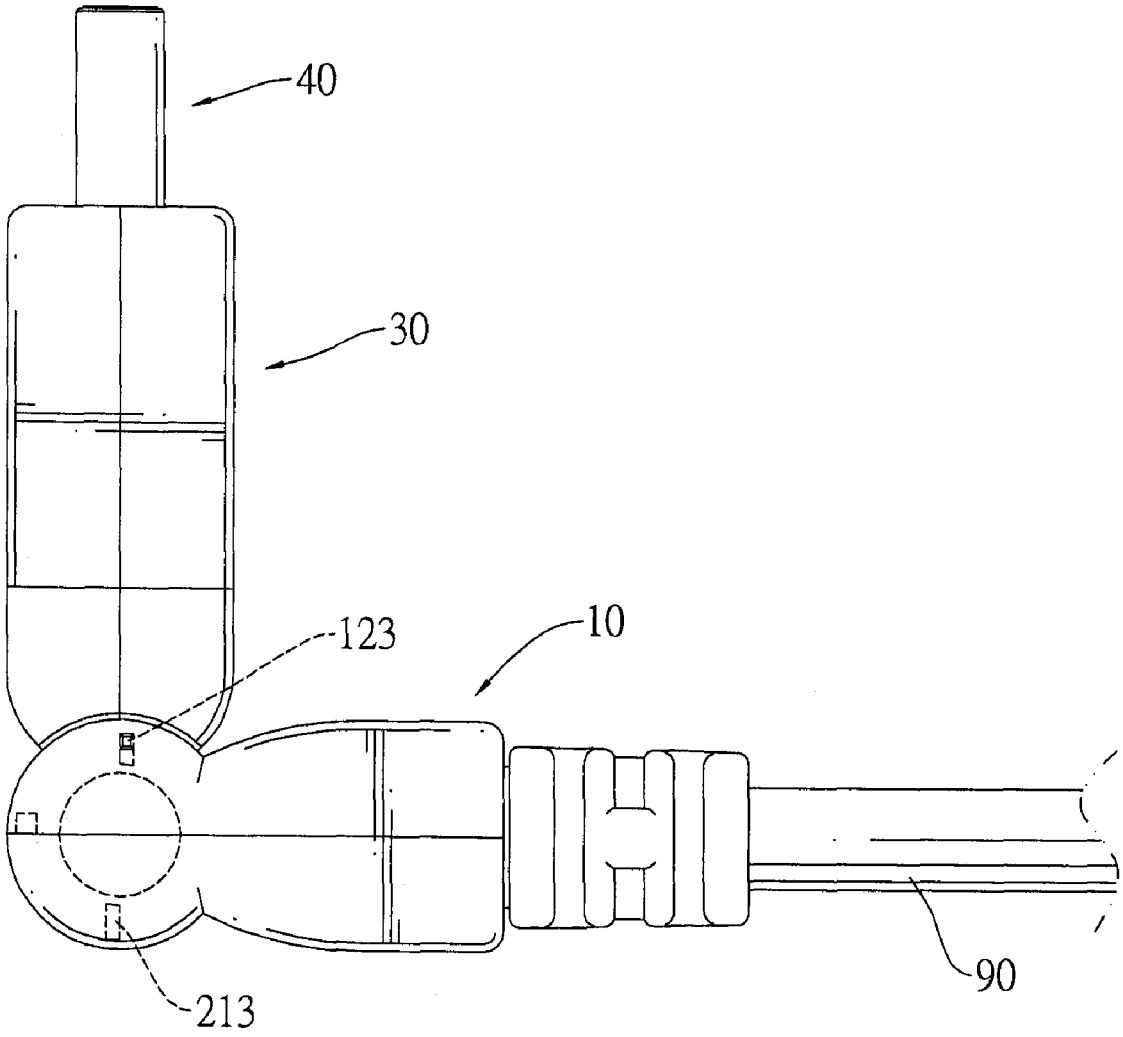
FIG. 10 is an operational side view of the pivot plug connector in FIG. 9.

With further reference to FIGS. 9 and 10, the pivot brackets (12) are formed on and protrude from the front end. Each pivot bracket (12) has a first positioning protrusion (123) formed on and protruding inwardly from the pivot bracket (12).

The interval is defined between the pivot brackets (12).

The pivot pins (13) are formed respectively on and protrude inward from the pivot brackets (12) and each pivot pin (13) has a through hole (131) defined through the pivot pin (13) and communicating with the cavity (11).

Figure 5:
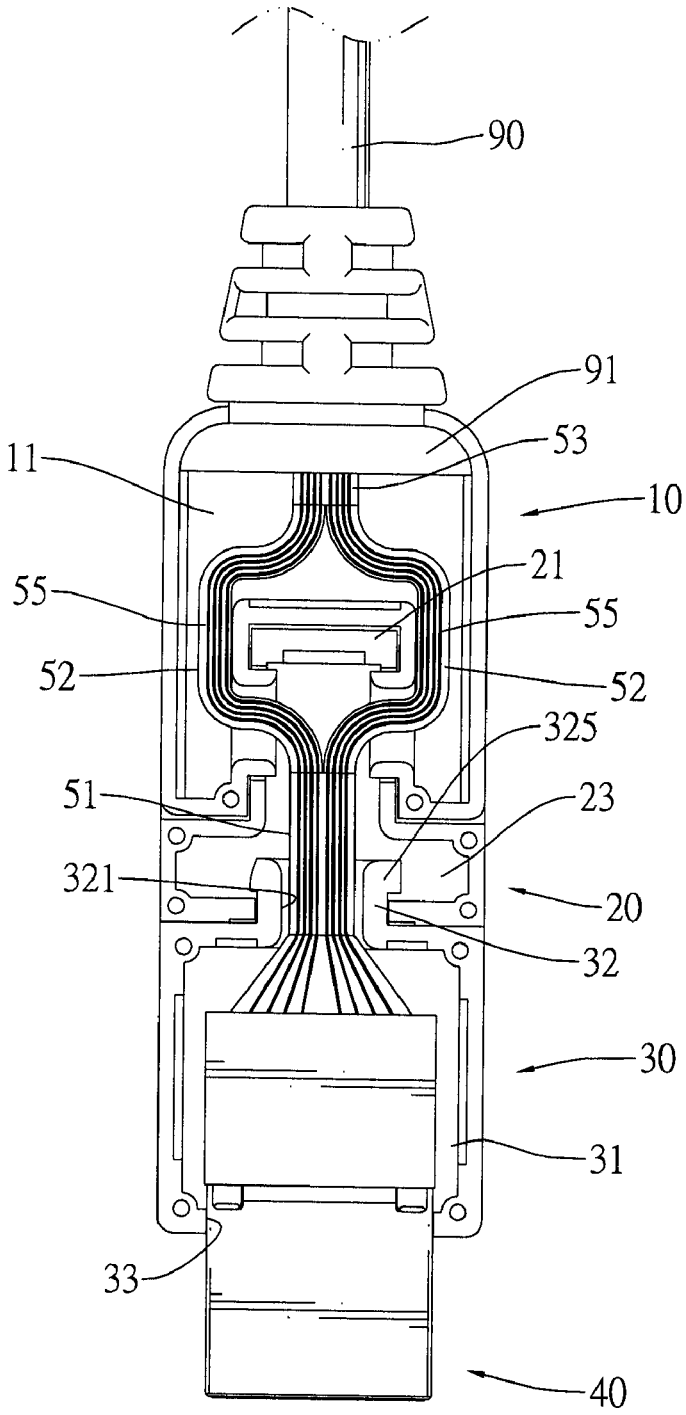
FIG. 5 is a top view in partial section of the pivot plug connector in FIG. 1.

With reference to FIG. 5, the pivoting member (20) is connected pivotally to the front end of the cable mount (10) so that the pivoting member (20) is capable of pivoting around the transverse axis (T). The pivoting member (20) may consist of two substantially symmetrical casing halves (200) and has a front end, a rear end, a longitudinal axis (L), a chamber (23) and may further have a pivot segment (21) and a supporting segment (22).

The chamber (23) is defined in the pivoting member (20) and may have an inner surface and at least one limiting protrusion (235) formed on the inner surface.

The pivot segment (21) is mounted pivotally on the pivot brackets (12) of the cable mount (10), may be mounted in the interval between the pivot brackets (12) and has two sides, a pivot hole (211) and two sets of multiple first positioning notches (213). The pivot hole (211) is defined transversely through the pivot segment (21), communicates with the chamber (23) and the through holes (131) and has two opposite openings respectively and rotatably accommodating the pivot pins (13) of the cable mount (10). The sets of the first positioning notches (213) are defined respectively in the sides of the pivot segment (21). Each set engages selectively with the first positioning protrusion (123) of one pivot bracket (12) of the cable mount (10) to position the pivoting member (20) in a specific angular position relative to the cable mount (10).

Figure 11:
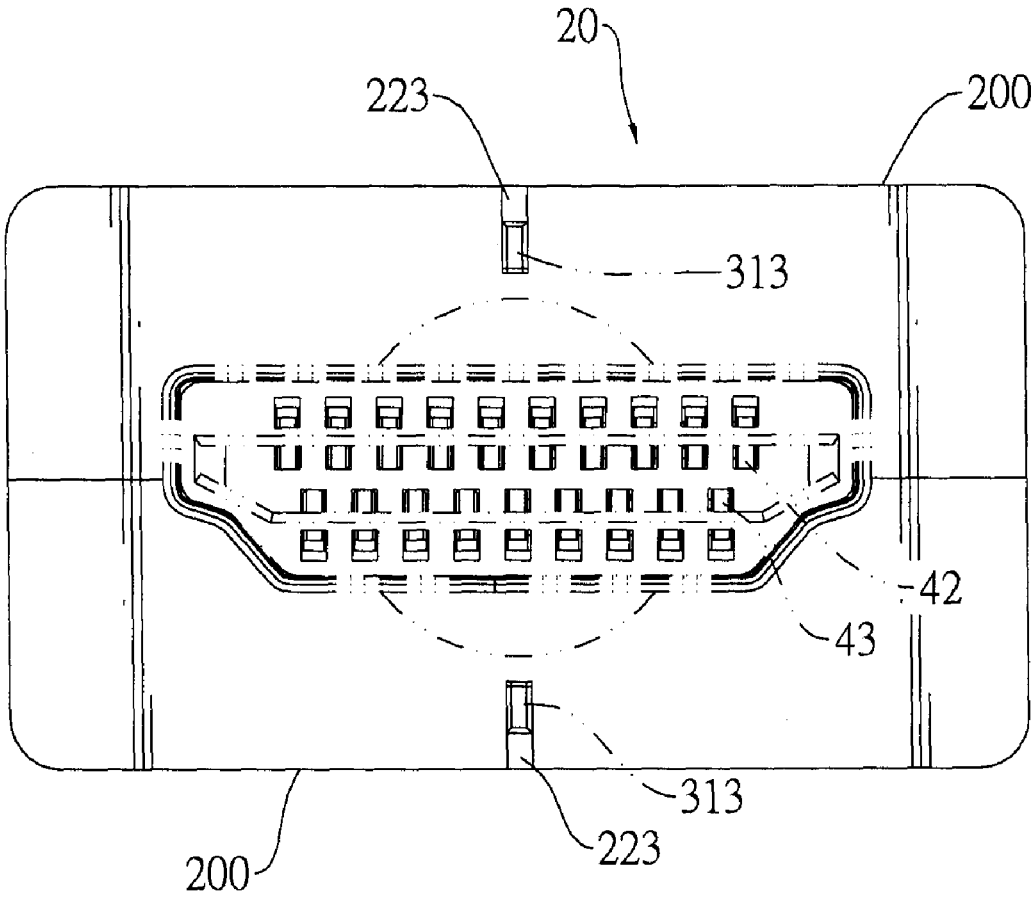
FIG. 11 is another cross sectional view of the pivot plug connector in FIG. 1.

With further reference to FIG. 11, the supporting segment (22) is formed on the pivot segment (21) and has a front end, a rotating element (221) and multiple second positioning notches (223). The rotating element (221) may be a pintle hole defined through the front end of the supporting segment (22) and communicating with the chamber (23). The second positioning notches (223) are defined in the front end of the supporting segment (22).

The rotating member (30) is connected rotatably to the pivoting member (20) so that the rotating member (30) is capable of rotating around the longitudinal axis (L) of the pivoting member (20). The rotating member (30) may be mounted rotatably on the front end of the supporting segment (22) of the pivoting member (20), may consist of two substantially symmetrical casing halves (300) and has a front end, a rear end, an internal space (31), a fastening hole (33) and may further have a rotating portion (32).

The internal space (31) is defined in the rotating member (30).

The fastening hole (33) is defined in the front end of the rotating member (30) and communicates with the internal space (31).

Figure 8:
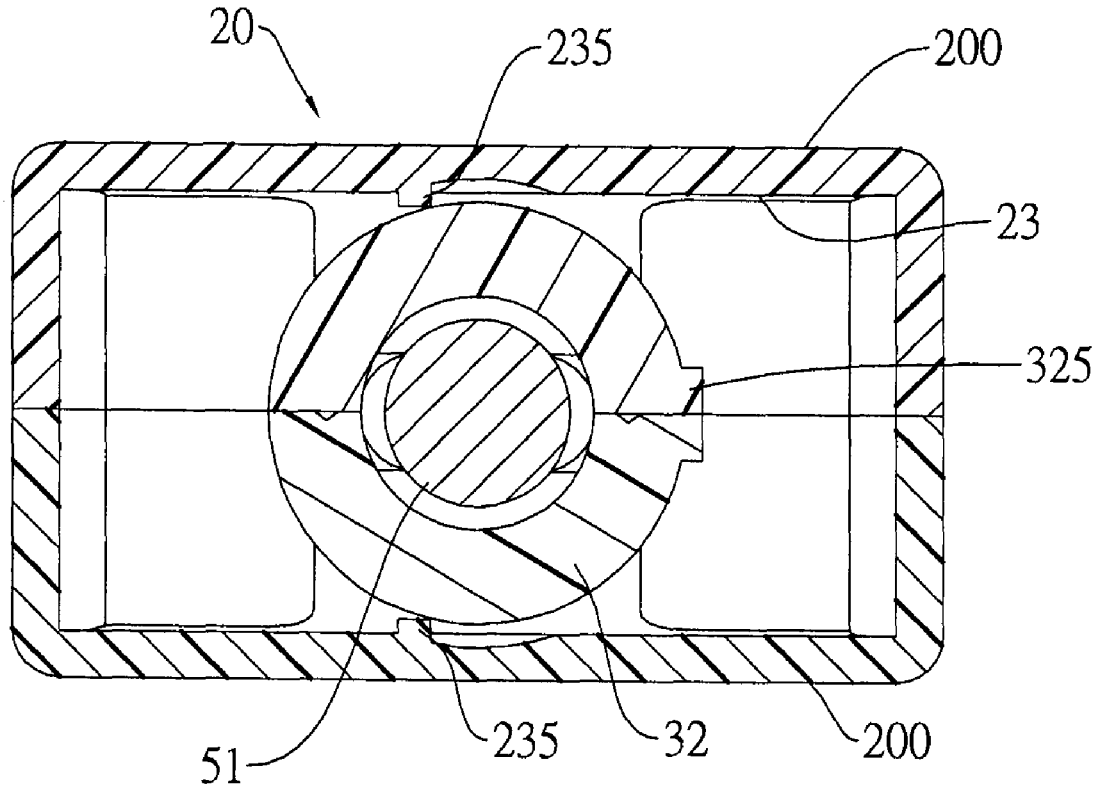
FIG. 8 is a cross sectional front view of the pivot plug connector in FIG. 1.

With further reference to FIG. 8, the rotating portion (32) is formed on the rear end of the rotating member (30), engages rotatably with the rotating element (221) of the pivoting member (20) and may be a pintle. The pintle protrudes from the rear end of the rotating member (30) and is mounted rotatably in the pintle hole of the pivoting member (20) and has an aperture (321), a limiting block (325) and a second positioning protrusion (313). The aperture (321) is defined through the pintle and communicates with the internal space (31). The limiting block (325) is formed on and protrudes radially from the pintle and selectively abuts the at least one limiting protrusion (235) in the chamber (23) of the pivoting member (20) to limit the rotating angle of the rotating member (30) relative to the pivoting member (20) and prevent wires in the pivot plug connector from over twisting and damage. The second positioning protrusion (313) is formed on and protrudes radially from the pintle and engages selectively with one of the second positioning notches (223) of the supporting segment (22) of the pivoting member (20) to position the rotating member (30) at a specific angular position relative to the pivoting member (20).

Figure 6:
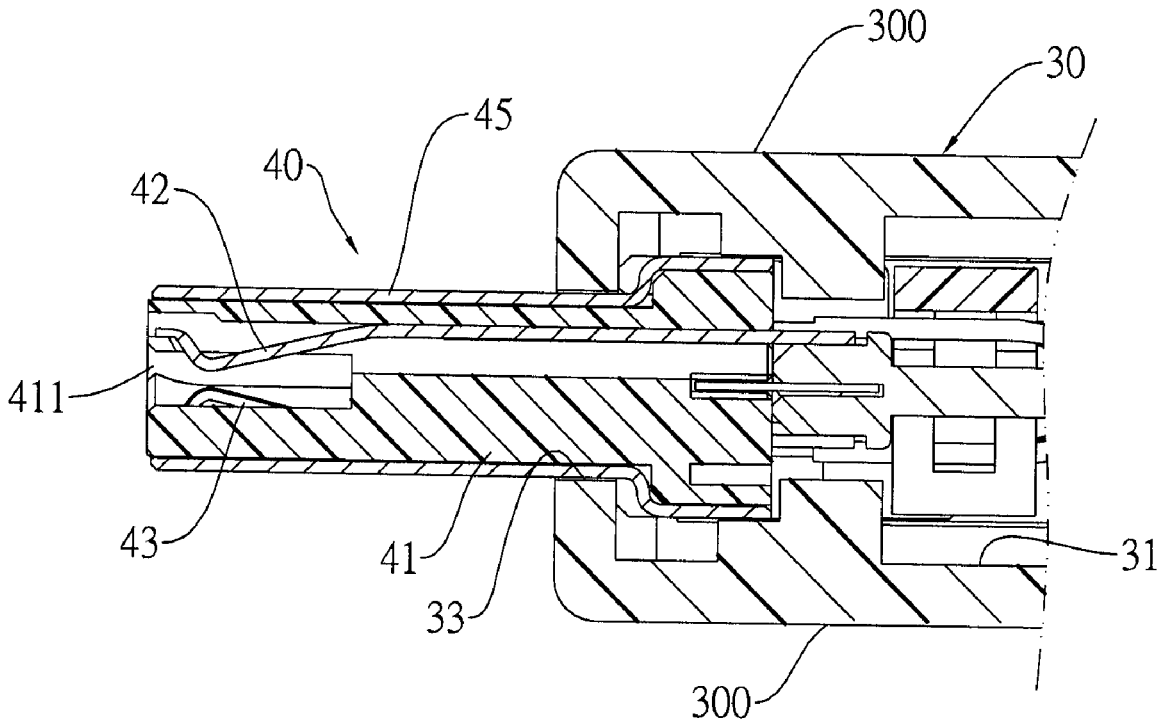
FIG. 6 is a cross sectional side view of the pivot plug connector in FIG. 1.
Figure 7:
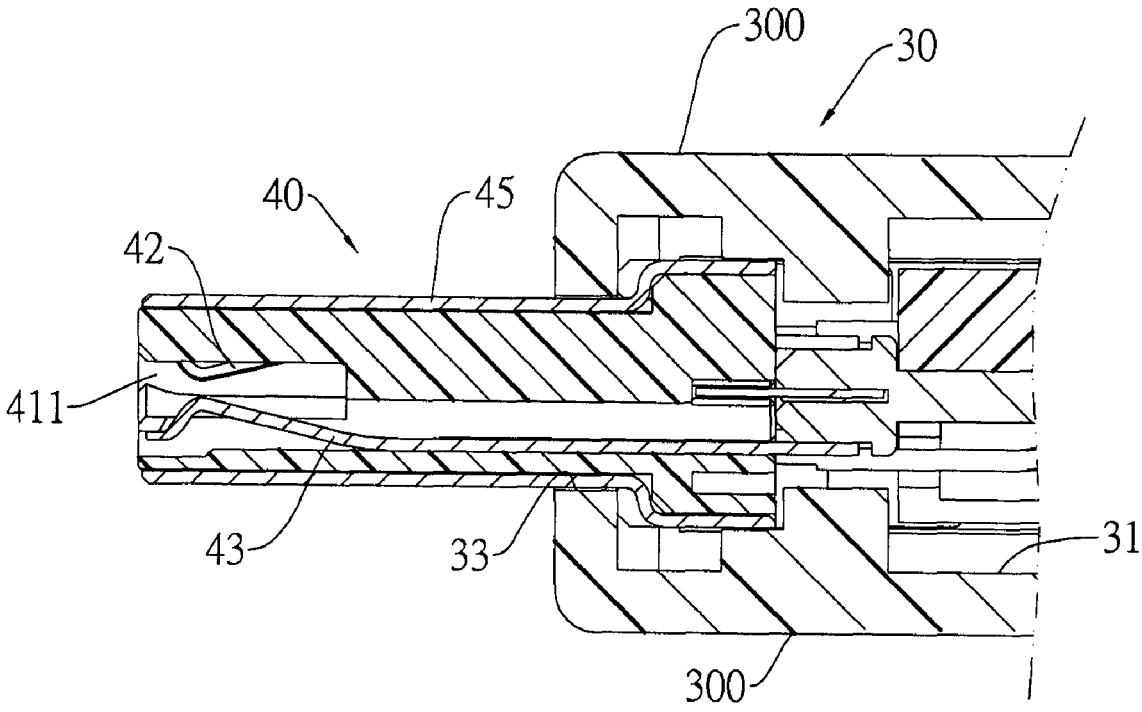
FIG. 7 is another cross sectional side view of the pivot plug connector in FIG. 1.

With further reference to FIGS. 6 and 7, the plug head (40) is mounted in the internal space (31) of the rotating member (30), extends out through the fastening hole (33) and has an insulative housing (41) and multiple terminals (42, 43) and may further have a shell (45).

The insulative housing (41) is mounted in the internal space (31) of the rotating member (30), extends out through the fastening hole (33) and has a front end and an engaging hole. The engaging hole is defined in the front end to accommodate a tongue of a corresponding socket connector and has an inner top surface and an inner bottom surface.

The terminals (42, 43) are mounted in the engaging hole and may be an upper row of terminals (42) mounted on the inner top surface and a lower row of terminals (43) mounted on the inner bottom surface. Each terminal (42, 43) has a rear end.

The shell (45) may be metal and covers the insulative housing (41).

The internal cable (50) is resilient, is connected to the rear ends of the terminals (42)(43), extends through the internal space (31) of the rotating member (30) and the chamber (23) of the pivoting member (20) and extends in the cavity (11) of the cable mount (10). The internal cable (50) may have a first sleeve (51), two second sleeves (52), a third sleeve (53) and multiple wires (55).

The first sleeve (51) is mounted through the aperture (321) of the rotating member (30) and the pintle hole of the pivoting member (20).

The second sleeves (52) are connected to the first sleeve (51), are mounted in the chamber (23) of the pivoting member (20), extend respectively through the openings of the pivot hole (211) of the pivot segment (21), extend respectively through the through holes (131) of the pivot pins (13) of the cable mount (10) and extend in the cavity (11).

The third sleeve (53) is connected to the second sleeves (52) and is mounted in the cavity (11) of the cable mount (10).

The wires (55) are connected respectively to the rear ends of the terminals (42)(43) directly or indirectly, are classified into two groups extending respectively through the second sleeves (52), all extend in the third sleeve (53) and are connected to the cable (90). While FIG. 5 shows some of the wires (55), the wires (55) correspond to the terminals (42) (43).

The pivoting member (20) is connected pivotally to the cable mount (30) and the rotating member (30) is connected rotatably to the pivoting member (20) and allows the pivot plug connector to selectively achieve L-shaped and twisted configurations. Therefore, the pivot plug connector can be adjusted to prevent interference with nearby plug connectors when plugged into a corresponding socket connector.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pivot plug connector comprising:

a cable mount having a transverse axis and a cavity defined in the cable mount;

a pivoting member connected pivotally to the front end of the cable mount so that the pivoting member is capable of pivoting around the transverse axis, the pivoting member having a front end, a rear end, a longitudinal axis and a chamber defined in the pivoting member;

a rotating member connected rotatably to the pivoting member so that the rotating member is capable of rotating around the longitudinal axis of the pivoting member, the rotating member having a front end, a rear end and further having an internal space defined in the rotating member; and a fastening hole defined in the front end of the rotating member and communicating with the internal space;

a plug head mounted in the internal space of the rotating member, extending out through the fastening hole and having multiple terminals mounted in the plug head; and an internal cable made of resilient material, connected to the rear ends of the terminals, extending through the internal space of the rotating member and the chamber of the pivoting member and extending into the cavity of the cable mount.

2. The pivot plug connector as claimed in claim 1, wherein the cable mount further has two pivot brackets formed on and protruding from the front end;

the pivoting member further has a pivot segment mounted pivotally on the pivot brackets of the cable mount; and a supporting segment formed on the pivot segment and having a front end and a rotating element formed on the front end;

the rotating member is mounted rotatably on the front end of the supporting segment of the pivoting member and further has a rotating portion formed on the rear end of the rotating member and engaging rotatably with the rotating element of the pivoting member.

3. The pivot plug connector as claimed in claim 2, wherein the cable mount further has an interval defined between the pivot brackets; and two pivot pins formed respectively on and protruding from the pivot brackets;

the pivot segment of the pivoting member is mounted in the interval between the pivot brackets and has two sides and a pivot hole defined transversely through the pivot segment and having two opposite openings respectively and rotatably accommodating the pivot pins of the cable mount;

the rotating element of the pivoting member is a pintle hole defined through the front end of the supporting segment;

the rotating portion of the rotating member is a pintle protruding from the rear end of the rotating member and mounted rotatably in the pintle hole of the pivoting member.

4. The pivot plug connector as claimed in claim 3, wherein each pivot pin of the cable mount has a through hole defined through the pivot pin and communicating with the cavity;

the pintle of the rotating member has an aperture defined through the pintle and communicating with the internal space;

the pintle hole of the pivoting member communicates with the chamber;

the pivot hole of the pivoting member communicates with the chamber and the through holes of the pivot pins of the cable mount; and the internal cable has a first sleeve mounted through the aperture of the rotating member and the pintle hole of the pivoting member;

two second sleeves connected to the first sleeve, mounted in the chamber of the pivoting member, extending respectively through the openings of the pivot hole of the pivot segment, extending respectively through the through holes of the pivot pins of the cable mount and extending in the cavity;

a third sleeve connected to the second sleeves and mounted in the cavity of the cable mount; and multiple wires connected respectively to the rear ends of the terminals, classified into two groups extending respectively through the second sleeves and all extending in the third sleeve.

5. The pivot plug connector as claimed in claim 4, wherein the chamber has an inner surface and at least one limiting protrusion formed on the inner surface; and the pintle of the rotating member further has a limiting block formed on and protruding radially from the pintle and selectively abutting the at least one limiting protrusion in the chamber of the pivoting member.

6. The pivot plug connector as claimed in claim 5, wherein each pivot bracket of the cable mount has a first positioning protrusion formed on and protruding inwardly from the pivot bracket; and the pivot segment of the pivoting member further has two sets of multiple first positioning notches defined respectively in the sides and each set engaging selectively with the first positioning protrusion of one pivot bracket.

7. The pivot plug connector as claimed in claim 6, wherein the plug head further has an insulative housing mounted in the internal space of the rotating member, extending out through the fastening hole and having a front end and an engaging hole defined in the front end of the insulative housing; and a shell covering the insulative housing; and the terminals are mounted in the in the engaging hole.

8. The pivot plug connector as claimed in claim 2, wherein the supporting segment of the pivoting member further has multiple positioning notches defined in the front end of the supporting segment; and the pintle of the rotating member further has a second positioning protrusion formed on and protruding radially from the pintle and engaging selective with one of the second positioning notches of the pivoting member.

9. The pivot plug connector as claimed in claim 1 further complying with the HDMI standard.

10. The pivot plug connector as claimed in claim 7 further complying with the HDMI standard.

* * * * *